US006907990B2

(12) United States Patent
Hu

(10) Patent No.: US 6,907,990 B2
(45) Date of Patent: Jun. 21, 2005

(54) TOOL TRY-ON DEVICE ASSEMBLY

(76) Inventor: Bobby Hu, 8F, No. 536-1,Ta Chin Street, Taichung (TW)

( * ) Notice: Subject to any disclaimer, the term of this patent is extended or adjusted under 35 U.S.C. 154(b) by 10 days.

(21) Appl. No.: 10/647,686

(22) Filed: Aug. 25, 2003

(65) Prior Publication Data

US 2004/0074796 A1 Apr. 22, 2004

(30) Foreign Application Priority Data

Oct. 22, 2002 (TW) ..... 91124667 A
Oct. 22, 2002 (TW) ..... 91124670 A

(51) Int. Cl.[7] ..... B65D 85/20
(52) U.S. Cl. ..... 206/378; 206/373; 211/70.6
(58) Field of Search ..... 206/349, 372, 206/374–379, 477–483; 211/70.6

(56) References Cited

U.S. PATENT DOCUMENTS 4,450,961 A * 5/1984 Bies et al. ..... 206/349
4,872,551 A * 10/1989 Theros ..... 206/349
5,044,591 A * 9/1991 Huang ..... 248/317
5,501,330 A * 3/1996 Betts ..... 206/349
5,906,350 A * 5/1999 Kao ..... 248/688
5,988,381 A * 11/1999 Ling ..... 206/349
6,164,463 A * 12/2000 Lee ..... 211/70.6
6,241,092 B1 * 6/2001 Vasudeva ..... 206/349
6,409,015 B1 * 6/2002 Hu ..... 206/378
2004/0016667 A1 * 1/2004 Chen ..... 206/373

* cited by examiner

*Primary Examiner*—Bryon P. Gehman
(74) *Attorney, Agent, or Firm*—Alan D. Kamrath; Nikolai & Mersereau, P.A.

(57) ABSTRACT

A tool try-on device includes a body and a frictional retaining member mounted to the body. The frictional retaining member and the body together define a compartment for receiving a rotatable member rotatably mounted to an end of a handle of a tool. The frictional retaining member exerts a frictional force to an outer surface of the rotatable member of the tool for retaining the rotatable member in place unless a rotational force greater than the frictional force is applied to the handle of the tool in a ratcheting direction.

22 Claims, 23 Drawing Sheets

TOOL TRY-ON DEVICE ASSEMBLY

BACKGROUND OF THE INVENTION

1. Field of the Invention

The present invention relates to a tool try-on device. In particular, the present invention relates to a device allowing a customer to try a tool such as a wrench before buying it.

2. Description of the Related Art

Taiwan Utility Model Publication No. 478450 discloses a tool rack including a board having a main portion. Two rows of socket-mounting pegs are provided on two lateral sides of the main portion of the board. A socket is releasably mounted on the respective socket-mounting peg. A tool-holding member is provided on an upper side of the main portion for releasably holding a tool such as a socket wrench. The tool rack can only provide a function of displaying the socket wrench and the sockets. A user could not know the exact operational condition of the socket wrench unless the user buys and uses it.

U.S. Pat. No. 5,785,174 discloses a display pack having a rotatable security member, allowing a customer to try a wrench before buying. The display pack includes a board having a hole. The rotatable security member includes a shank having a toothed periphery that is engaged with a toothed inner periphery delimiting the hole of the board. An end of a wrench may be engaged with the rotatable security member and turned. The rotatable security member rotates in the hole of the board, with the toothed periphery of the rotatable security member shifting on the toothed inner periphery delimiting the hole. The wrench is operated as if it is fastening or unfastening a fastener. However, the try-on function provided by the teeth-to-teeth engagement is lost once the teeth are worn out. Further, formation of the teeth incurs additional cost in manufacture. U.S. Pat. No. 6,409,015 discloses a tool pack with a flexible portion and a try-on device. The try-on device also uses a teeth-to-teeth engagement to provide a try-on function and thus has the same disadvantages.

SUMMARY OF THE INVENTION

An object of the present invention is to provide a tool try-on device without using teeth-to-teeth engagement.

In accordance with one aspect of the invention, a tool try-on device includes a body and a frictional retaining member mounted to the body. The frictional retaining member and the body together define a compartment for receiving a rotatable member rotatably mounted to an end of a handle of a tool. The frictional retaining member exerts a frictional force to an outer surface of the rotatable member of the tool for retaining the rotatable member in place unless a rotational force greater than the frictional force is applied to the handle of the tool in a ratcheting direction.

The rotatable member is not turned when the handle of the tool is turned in a reverse direction reverse to the ratcheting direction.

In an embodiment of the invention, the body includes two through-holes extending from a first side of the body to a second side of the body opposite to the first side of the body, with the frictional retaining member extending through the through-holes of the body and extending across a portion of the outer surface of the rotatable member of the tool, thereby exerting the frictional force to the rotatable member of the tool. The frictional retaining member includes a first end having a hole and a second end having a toothed side. The second end of the frictional retaining member extends through the hole of the first end of the frictional retaining member, with the toothed side of the second end of the frictional retaining member engaging with a toothed wall delimiting the hole of the first end of the frictional retaining member. The body may include a recessed portion for receiving the rotatable member and the end of the handle of the tool. The recessed portion of the body includes an end wall for preventing the tool from being removed.

In another embodiment of the invention, the frictional retaining member includes two ends each having a snapping member formed thereon. Each snapping member of the frictional retaining member is engaged with the respective through-hole of the body. The first side of the body may include an arcuate groove for receiving a portion of the rotatable member.

In a further embodiment of the invention, the body includes two snapping members formed on the first side thereof. The frictional retaining member includes two ends each having a hole defined therein. The respective snapping member of the body engages with the respective hole of the frictional retaining member, thereby securing the frictional retaining member to the body and exerting the frictional force to the rotatable member of the tool.

In still another embodiment of the invention, the body includes two through-holes extending from a first side of the body to a second side of the body opposite to the first side of the body. The frictional retaining member includes two ends each having a hole defined therein. A snapping member engages with the respective hole of the frictional retaining member and the respective hole of the body, thereby securing the frictional retaining member to the body and exerting the frictional force to the rotatable member of the tool.

In yet another embodiment of the invention, the body includes a through-hole extending from a first side of the body to a second side of the body opposite to the first side of the body. The frictional retaining member includes a first end integrally formed with the body and a second end having a snapping member formed thereon. The snapping member is engaged in the through-hole of the body, thereby exerting the frictional force to the rotatable member of the tool. A groove may be defined in a joint area between the first end of the frictional retaining member and the body, providing a pivotal section about which the second end of the frictional retaining member is pivotable.

In still another embodiment of the invention, the frictional retaining member includes two ends that are integrally formed with the body. A wall that delimits the compartment defined between the frictional retaining member and the body has an arcuate groove for receiving a portion of the rotatable member of the tool.

In yet another embodiment of the invention, the body includes a first casing half and a second casing half each having a recessed portion that together define the compartment for receiving the rotatable member and the end of the handle of the tool. The first casing half and the second casing half include aligned holes through which the frictional retaining member extends. The frictional retaining member is mounted around the recessed portions, thereby exerting the frictional force to the rotatable member of the tool. The frictional retaining member includes a first end having a hole and a second end having a toothed side. The second end of the frictional retaining member extends through the hole of the first end of the frictional retaining member, with the toothed side of the second end of the frictional retaining member engaging with a toothed wall delimiting the hole of the first end of the frictional retaining member.

The tool try-on device may further include a stop on the first side of the body for preventing the tool from being removed. In an alternative embodiment, the frictional retaining member includes an integral stop extending therefrom for preventing the tool from being removed. The integral stop of the frictional retaining member is preferably L-shaped.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
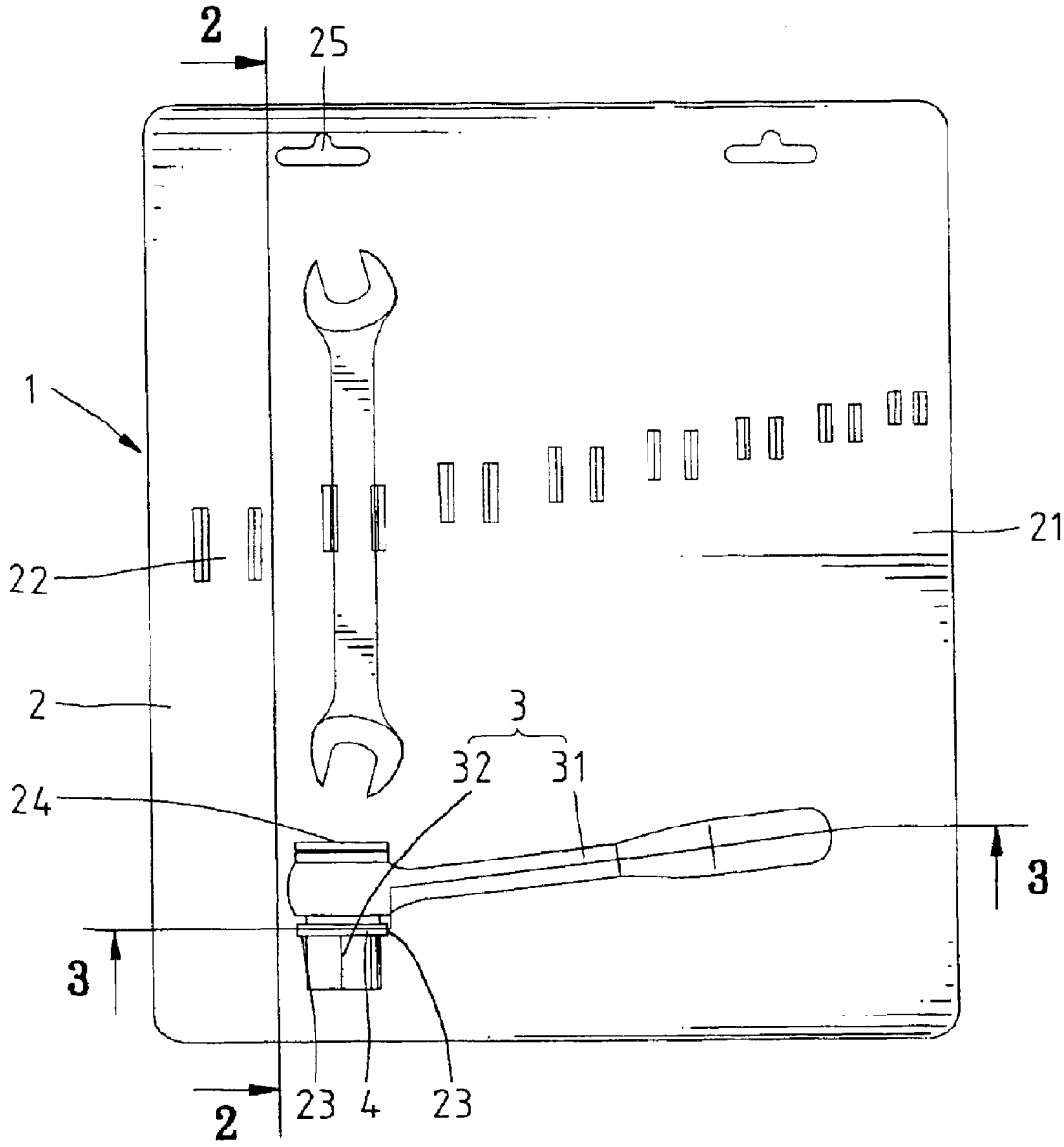
FIG. 1 is a front view of a first embodiment of a tool try-on device in accordance with the present invention, wherein the tool-try-on device is placed in an upright position.

Referring to FIG. 1, a first embodiment of a tool try-on device 1 in accordance with the present invention comprises a board or body 2 and a frictional retaining member 4. For illustration, the body 2 in FIG. 1 is an upright position. The board or body 2 may be formed by injection molding and includes a tool-holding section 21 having a plurality of tool-holding members 22 for releasably holding tools such as spanners, combination wrenches, ratchet wrenches, etc. The body 2 may further include at least one hanging hole 25, allowing the body 2 to be hung on a wall or the like.

Figure 2:
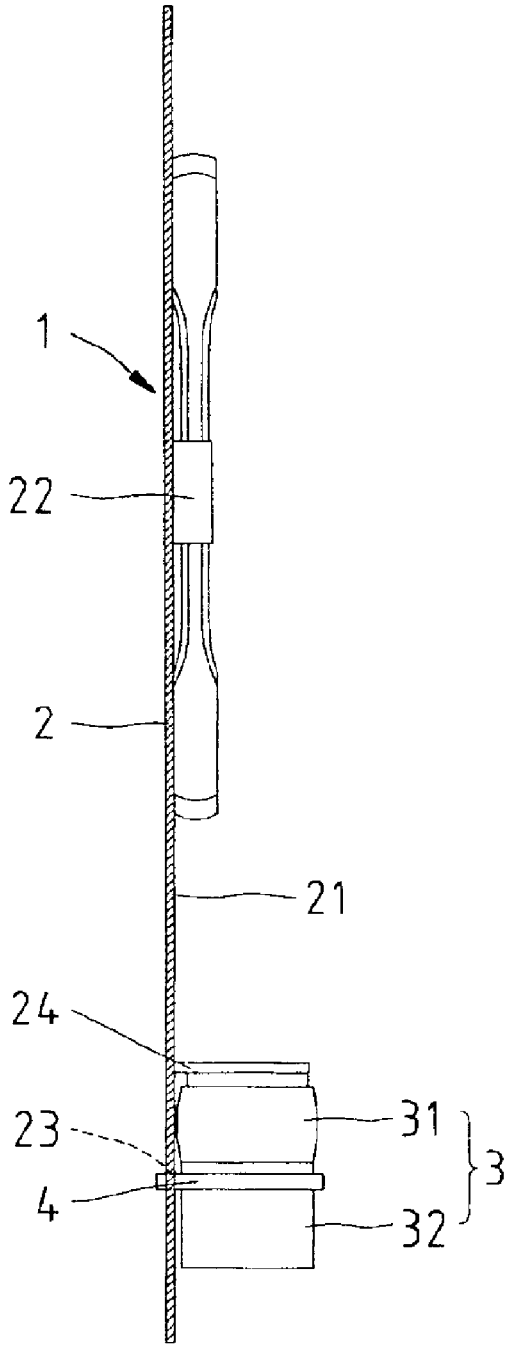
FIG. 2 is a sectional view taken along plane 2—2 in FIG. 1.
Figure 3:
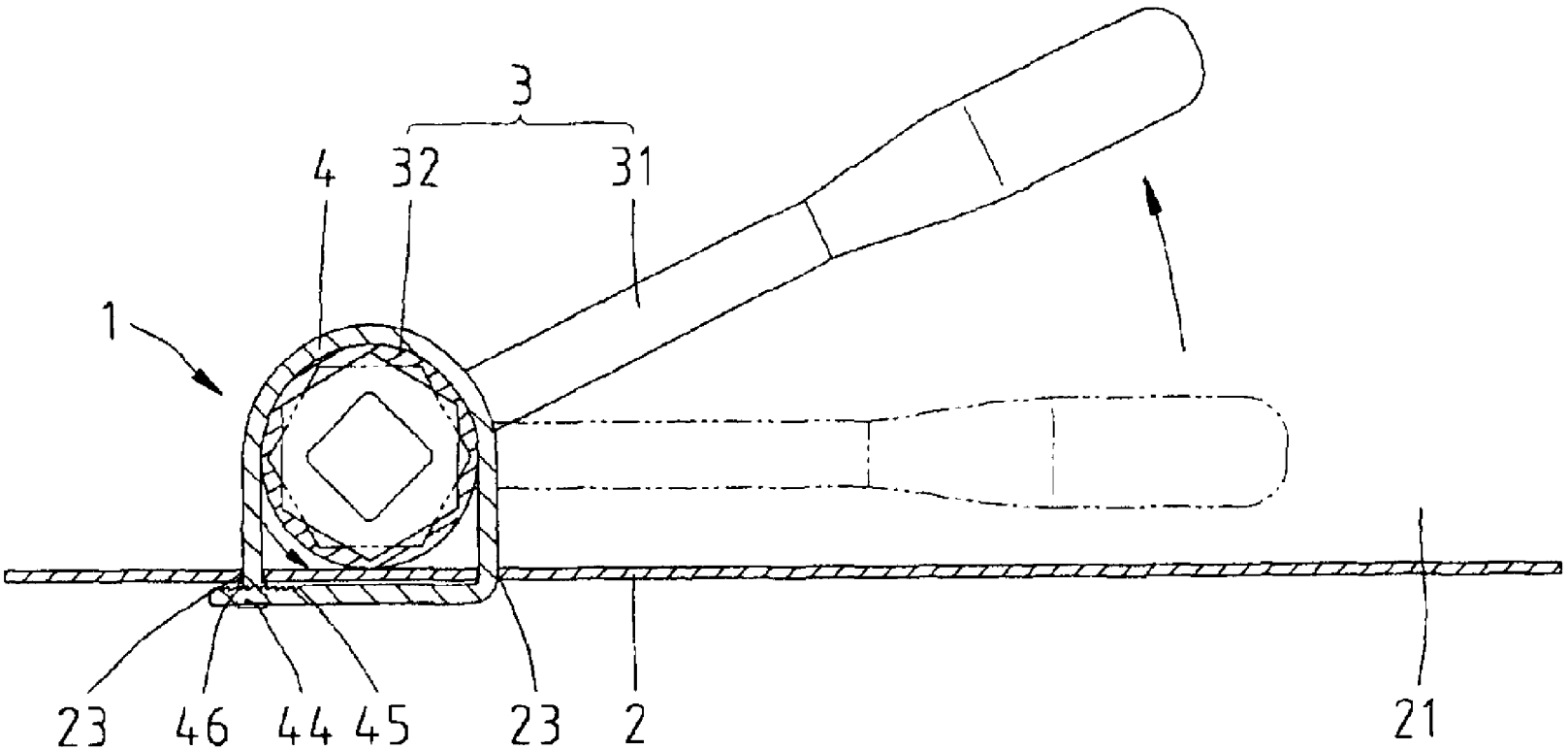
FIG. 3 is a sectional view taken along plane 3—3 in FIG. 1.

Of more importance, the body 2 includes two through-holes 23 extending from a side of the body to the other side of the body 2 for mounting the frictional retaining member 4. A stop 24 is provided on the body 2 and adjacent to the through-holes 23. Referring to FIGS. 2 and 3, the frictional retaining member 4 in this embodiment is a strap wound around a rotatable member 32 of a tool 3. More particularly, the strap includes a first end having a hole 44 and a second end having a toothed side 45. The tool 3 is placed on an upper side (see FIG. 3) of the body 2. The strap is placed below the body 2, with the second end of the strap passing through one of the through-holes 23 of the body 2, crossing an upper surface of the rotatable member 32 of the tool 3, passing through the other through-hole 23 of the body 2, and passing through the hole 44 of the first end of the strap. The toothed side 45 of the second end of the strap is engaged with a toothed wall 46 delimiting the hole 44 of the first end of the strap.

The strap is tightened to an extent that the upper surface of the rotatable member 32 of the tool 3 is in frictional contact with the strap (i.e:, the frictional retaining member 4). Preferably, the frictional retaining member 4 includes a non-smooth inner side or an inner side having a non-smooth section. The tool 3 is retained by the frictional retaining member 4. Further, a handle 31 of the tool 3 has an end in contact with the stop 24 on the body 2. Thus, the stop 24 prevents removal of the tool 3 from the body 2 unless the frictional retaining member 4 is removed. This provides an anti-theft function when the tool try-on device 1 is on display.

The rotatable member 32 may be rotatably attached to the end of the handle 31 in a conventional manner. In use, if the handle 31 of the tool 3 is turned in a direction, e.g., counterclockwise, and if the rotational force applied to the rotatable member 32 of the tool 3 is greater than the frictional force between the rotatable member 32 and the frictional retaining member 4, the rotatable member 32 is turned together with the handle 31 relative to the body 2, as shown in FIG. 3.

Figure 4:
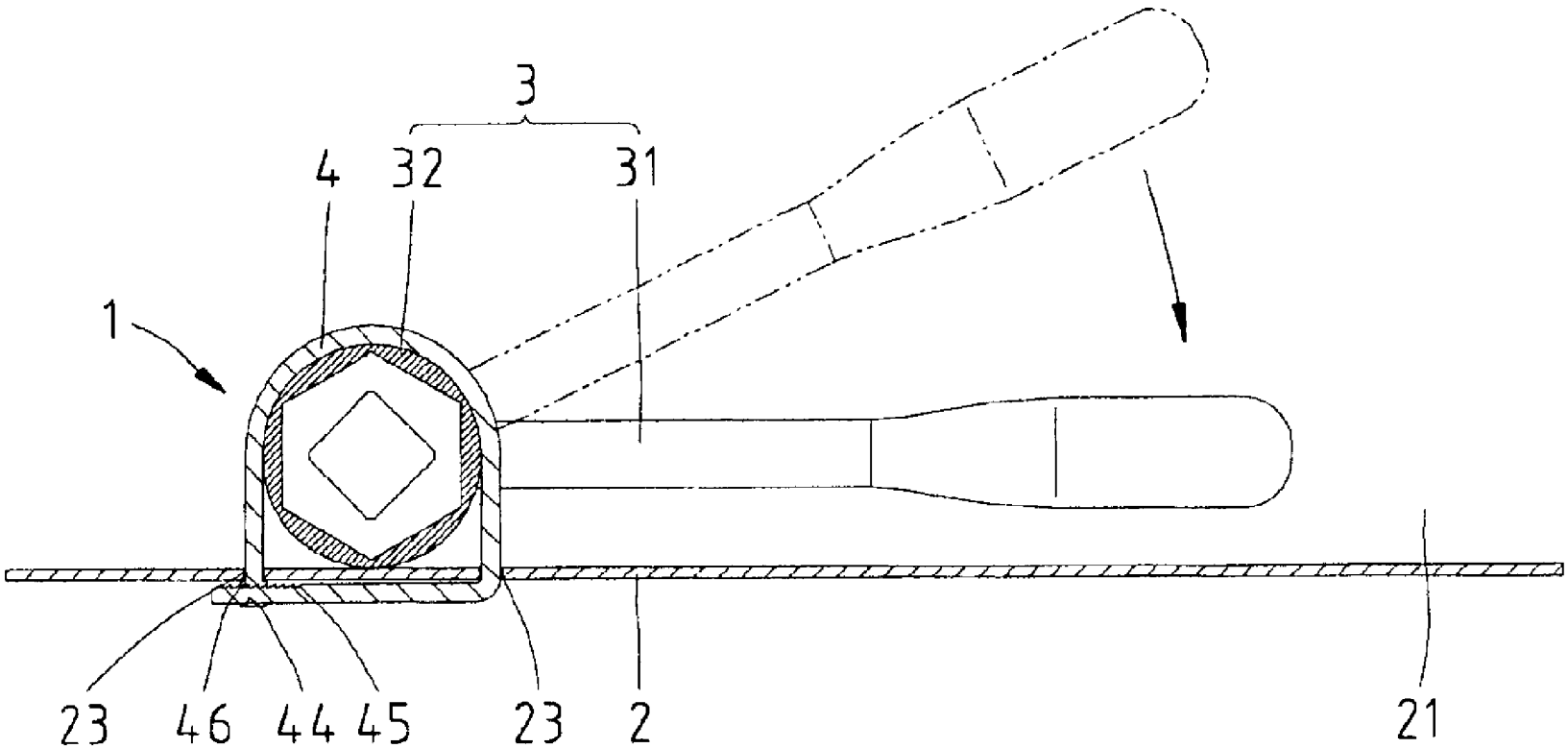
FIG. 4 is a view similar to FIG. 3, illustrating try-on of a tool in a reverse direction.

If the handle 31 of the tool 3 is turned in a reverse direction, e.g., clockwise, the rotational force of the handle 31 is absorbed by a ratchet mechanism mounted in the end of the handle 31 of the tool 3 without causing rotational movement of the rotatable member 32. Thus, the rotatable member 32 is not turned when the handle 31 of the tool 3 is turned in the reverse direction, as illustrated in FIG. 4. The ratchet mechanism allowing free rotation of the handle 31 of the tool 3 without causing rotational movement of the rotatable member 32 may be of a conventional design.

A customer may try the tool 3 by turning the handle 31 in the counterclockwise direction as well as in the clockwise direction before buying the tool 3. This would attract the customer, as the tool 3 is operated as if in a real operation for tightening/loosening a fastener.

Figure 5:
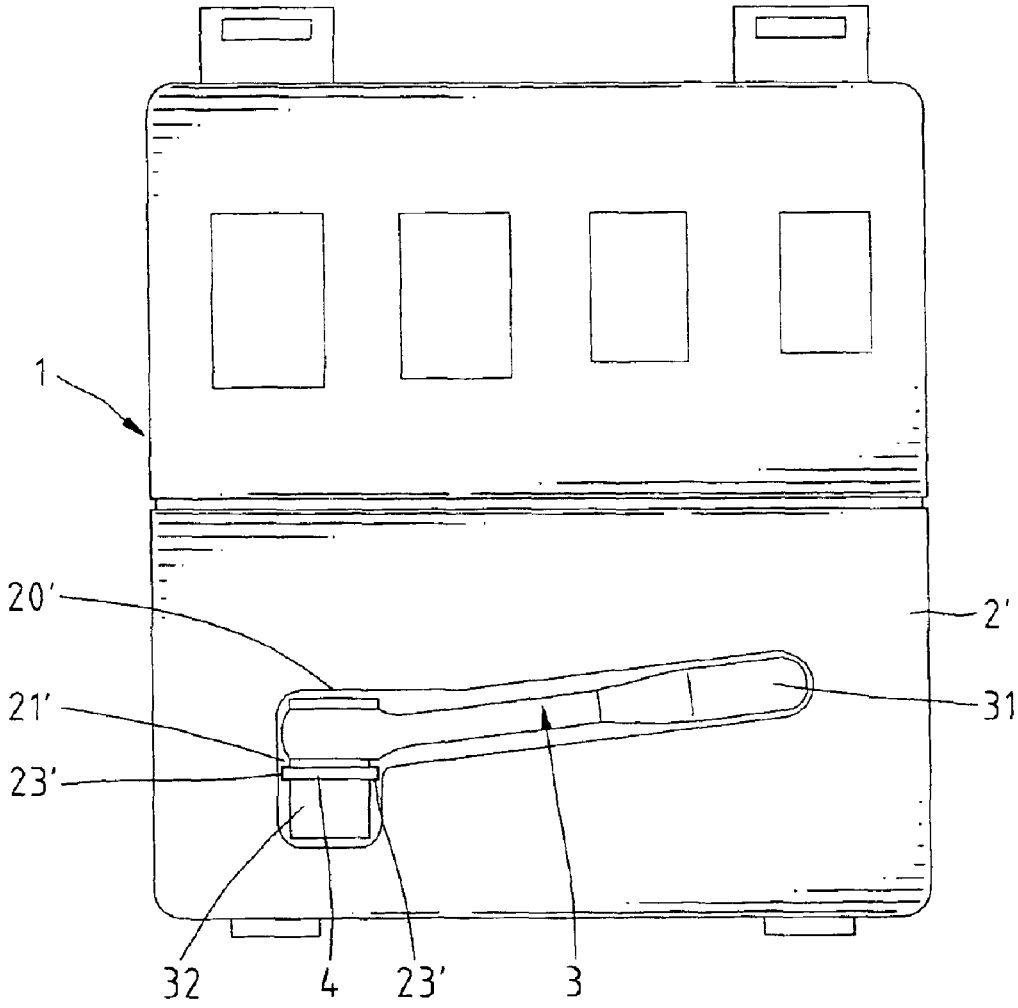
FIG. 5 is a front view of a second embodiment of the tool try-on device in accordance with the present invention.
Figure 6:
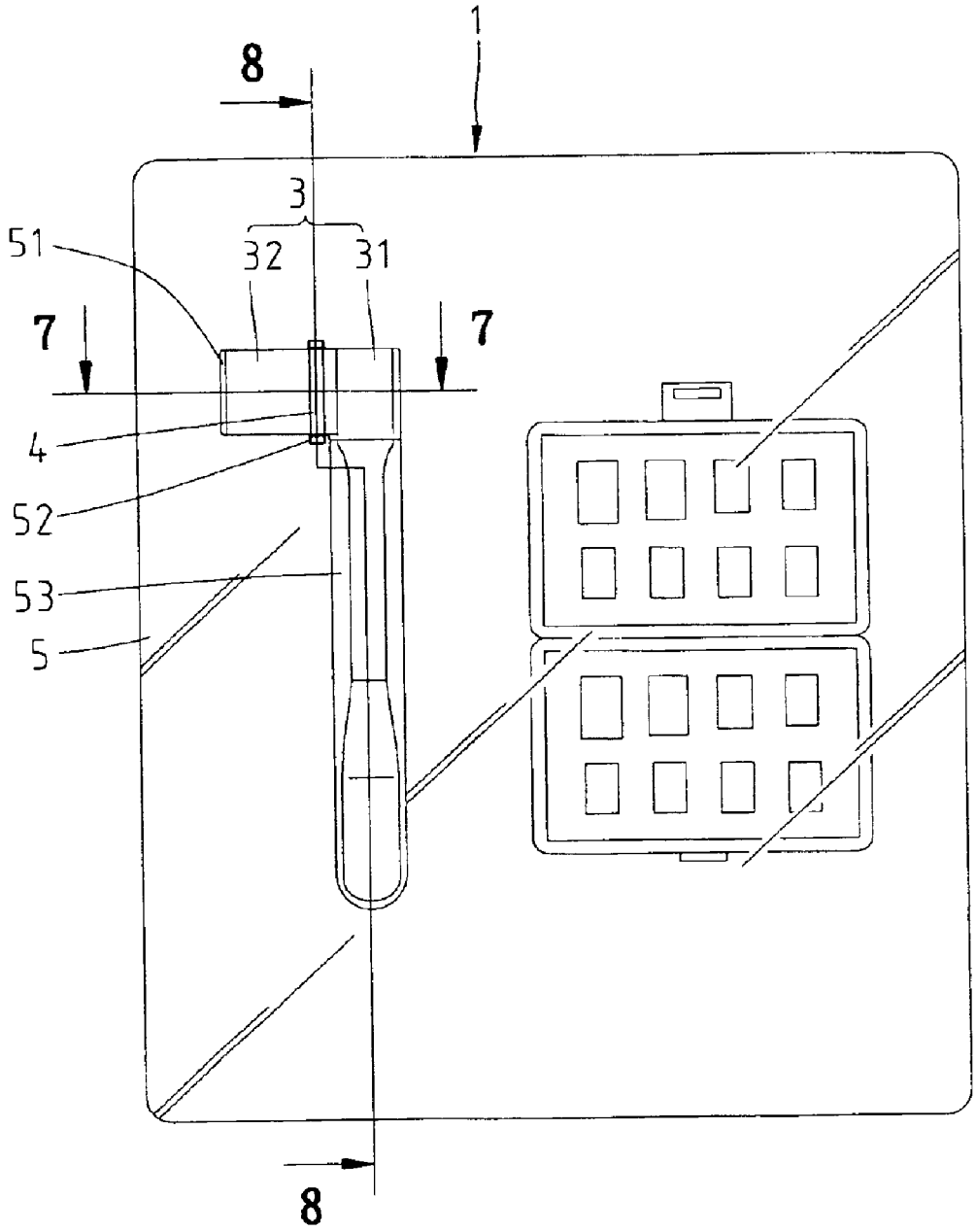
FIG. 6 is a front view of a third embodiment of the tool try-on device in accordance with the present invention.

FIG. 5 illustrates a second embodiment of the tool try-on device 1 in accordance with the present invention, wherein like reference numerals designate like elements. In this embodiment, the body (now designated by 2') is a box formed by blow molding and includes a recessed portion 21 ' in a side thereof for accommodating at least the rotatable member 32 of the tool 3. Two through-holes 23' are defined in a bottom wall delimiting the recessed portion 21 ' for mounting the frictional retaining member 4. An end of the handle 31 of the tool 3 abuts against an end wall 20' of the recessed portion 21', avoiding removal of the tool 3 unless the frictional retaining member 4 is removed. Operation of the second embodiment is substantially the same as that of the first embodiment.

Figure 7:
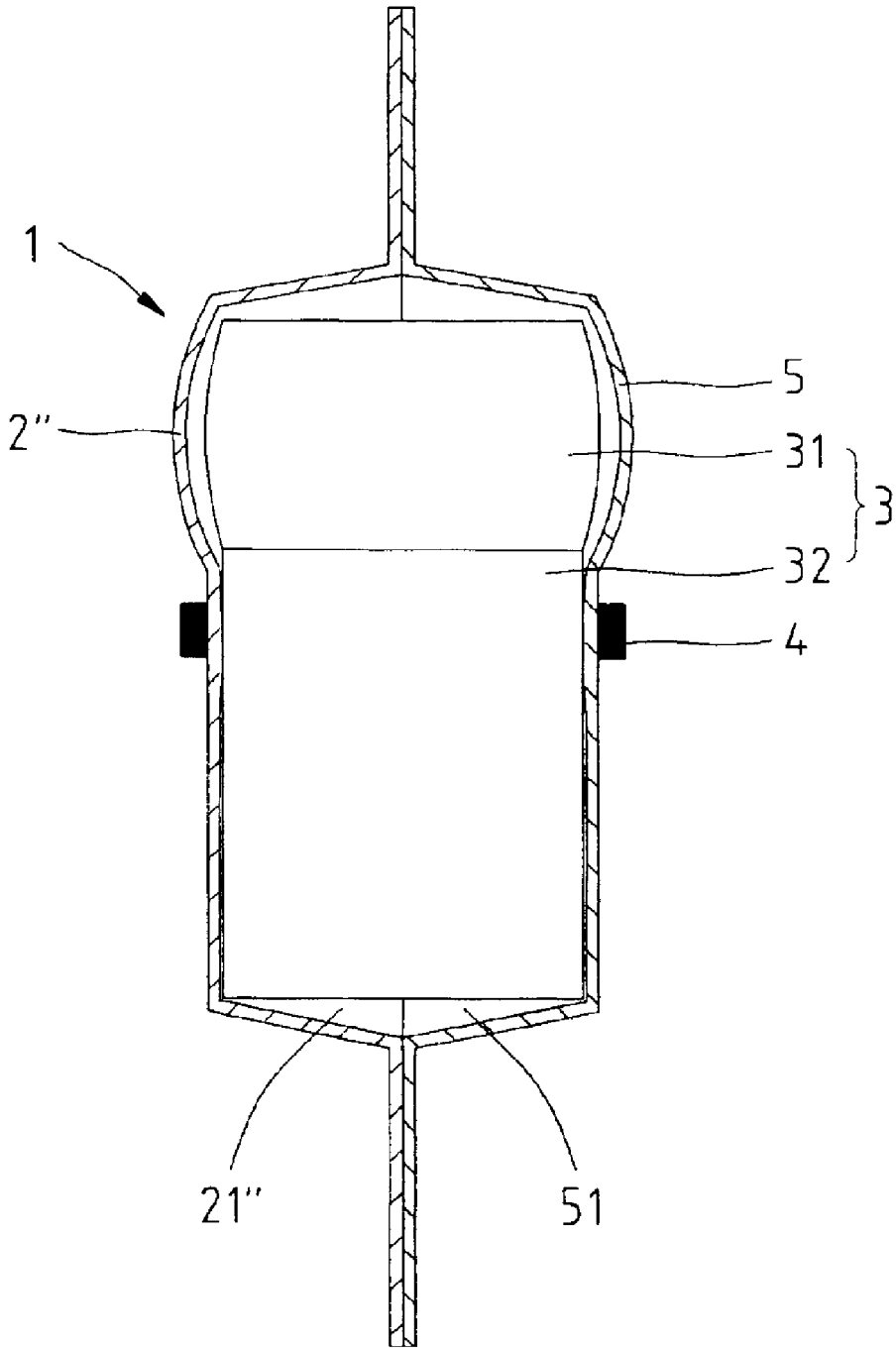
FIG. 7 is a sectional view taken along plane 7—7 in FIG. 6.
Figure 8:
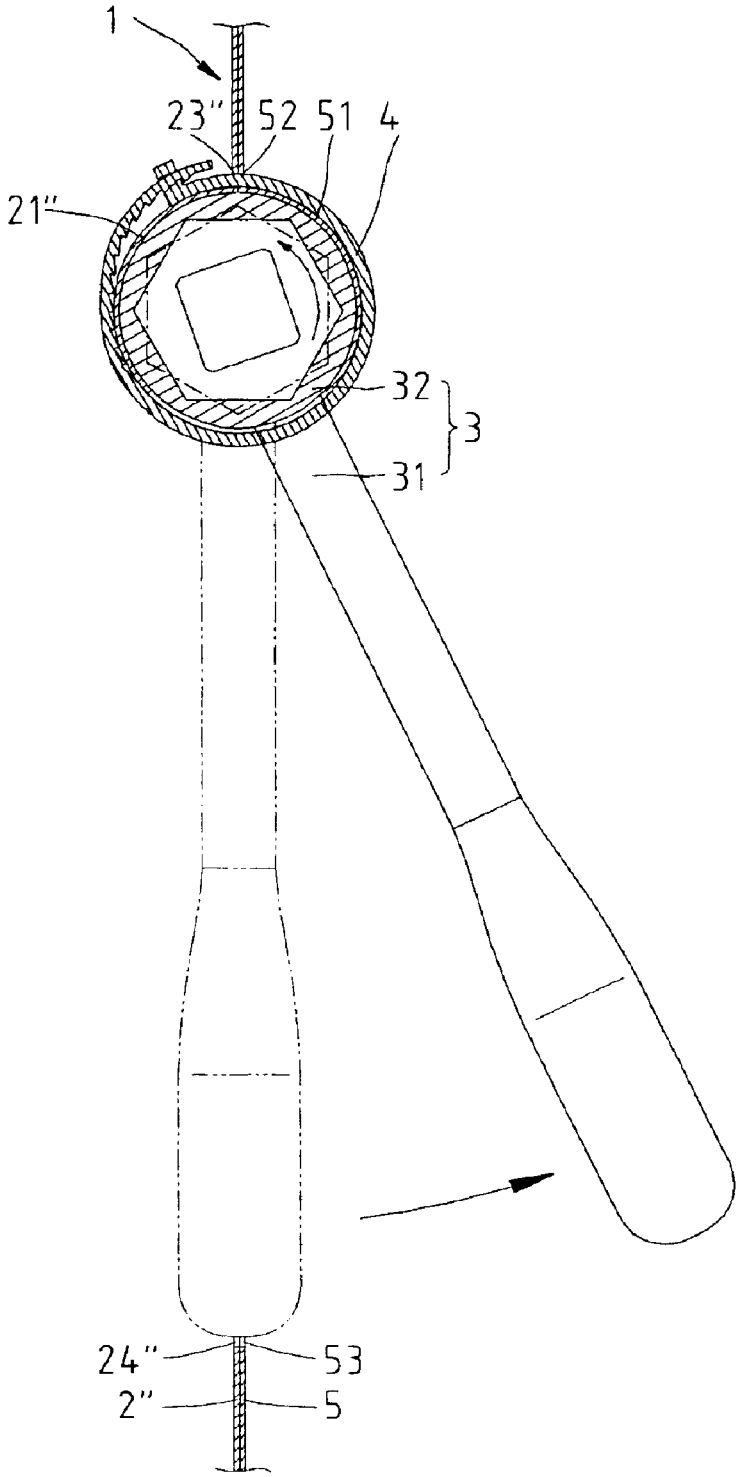
FIG. 8 is a sectional view taken along plane 8—8 in FIG. 6.

FIGS. 6 through 9 illustrate a third embodiment of the tool try-on device 1 in accordance with the present invention. In this embodiment, the body includes a transparent first casing half 2" and a transparent second casing half 5 (FIG. 7) that are made of molding injection and that together define a compartment for receiving the rotatable member 32 and an end of the handle 31 of the tool 3. In particular, the transparent first casing half 2" includes a recessed portion 21" and the transparent second casing half 5 includes a recessed portion 51, the recessed portions 21" and 51 together defining a compartment for receiving the rotatable member 32 and an end of the handle 31 of the tool 3, as shown in FIG. 7. Further, a bottom wall delimiting the recessed portion 21" of the transparent first casing half 2" includes two through-holes 23" through which the frictional retaining member 4 extends. A bottom wall delimiting the recessed portion 51 of the transparent second casing half 5 includes two holes 52 through which the frictional retaining member 4 extends. As illustrated in FIG. 8, the frictional retaining member 4 is extended through the through-holes 23" and 52, with the first end of the frictional retaining member 4 extending through the hole 44 in the second end of the frictional retaining member 4 and with the toothed side 45 being engaged with the toothed wall 46 delimiting the hole 44 of the first end of the frictional retaining member 4, which is substantially the same as that for the first embodiment (see FIG. 3). The transparent casing halves 2" and 5 are in frictional contact with the outer surface of the rotatable member 32 of the tool 3 under the action of a clamping force provided by the frictional retaining member 4.

Figure 9:
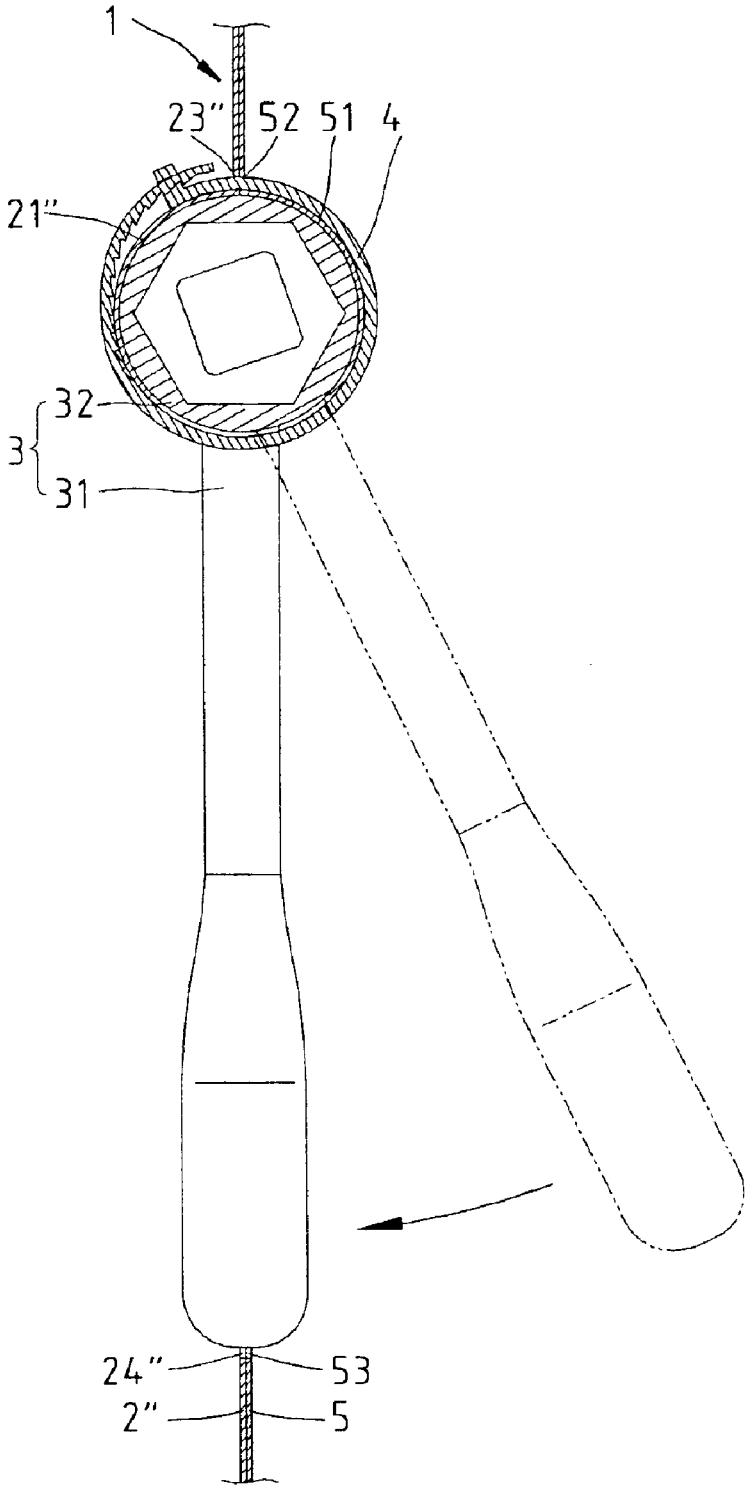
FIG. 9 is a view similar to FIG. 8, illustrating try-on of a tool in a reverse direction.

Further, the transparent casing halves 2" and 5 include aligned openings 24" and 53 for accommodating the handle 31 of the tool 3 and allowing turning of the handle 31. A customer may turn the handle 31 of the tool 3 in a direction, e.g., counterclockwise. If the rotational force applied to the rotatable member 32 of the tool 3 is greater than the frictional force between the rotatable member 32 and the transparent casing halves 2" and 5 imparted by the frictional retaining member 4, the rotatable member 32 is turned together with the handle 31 relative to the body of the tool try-on device 1, as shown in FIG. 8. The customer may turn the handle 31 of the tool 3 in a reverse direction, e.g., clockwise, in which the rotational force of the handle 31 is absorbed by a ratchet mechanism mounted in the end of the handle 31 of the tool 3 without causing rotational movement of the rotatable member 32. Thus, the rotatable member 32 is not turned when the handle 31 of the tool 3 is turned in the reverse direction, as illustrated in FIG. 9. Thus, the customer may try the tool 3 by turning the handle 31 in the counterclockwise direction as well as in the clockwise direction before buying the tool 3.

Figure 10:
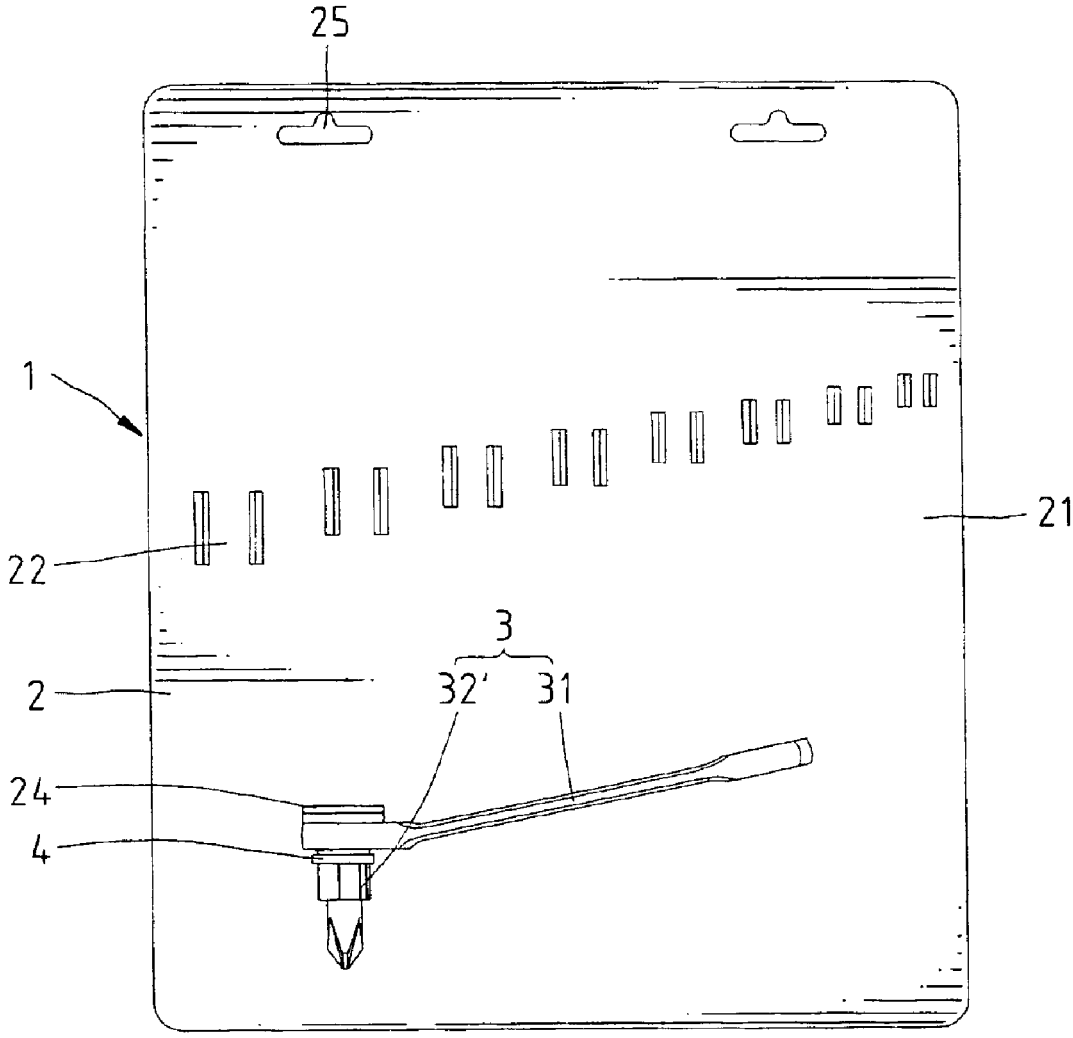
FIG. 10 is a front view of a fourth embodiment of the tool try-on device in accordance with the present invention.

FIG. 10 illustrates a fourth embodiment of the try-on device 1 in accordance with the present invention, wherein the rotatable member (now designated by 32') is in the form of an adaptor to which a bit is attached.

Figure 11:
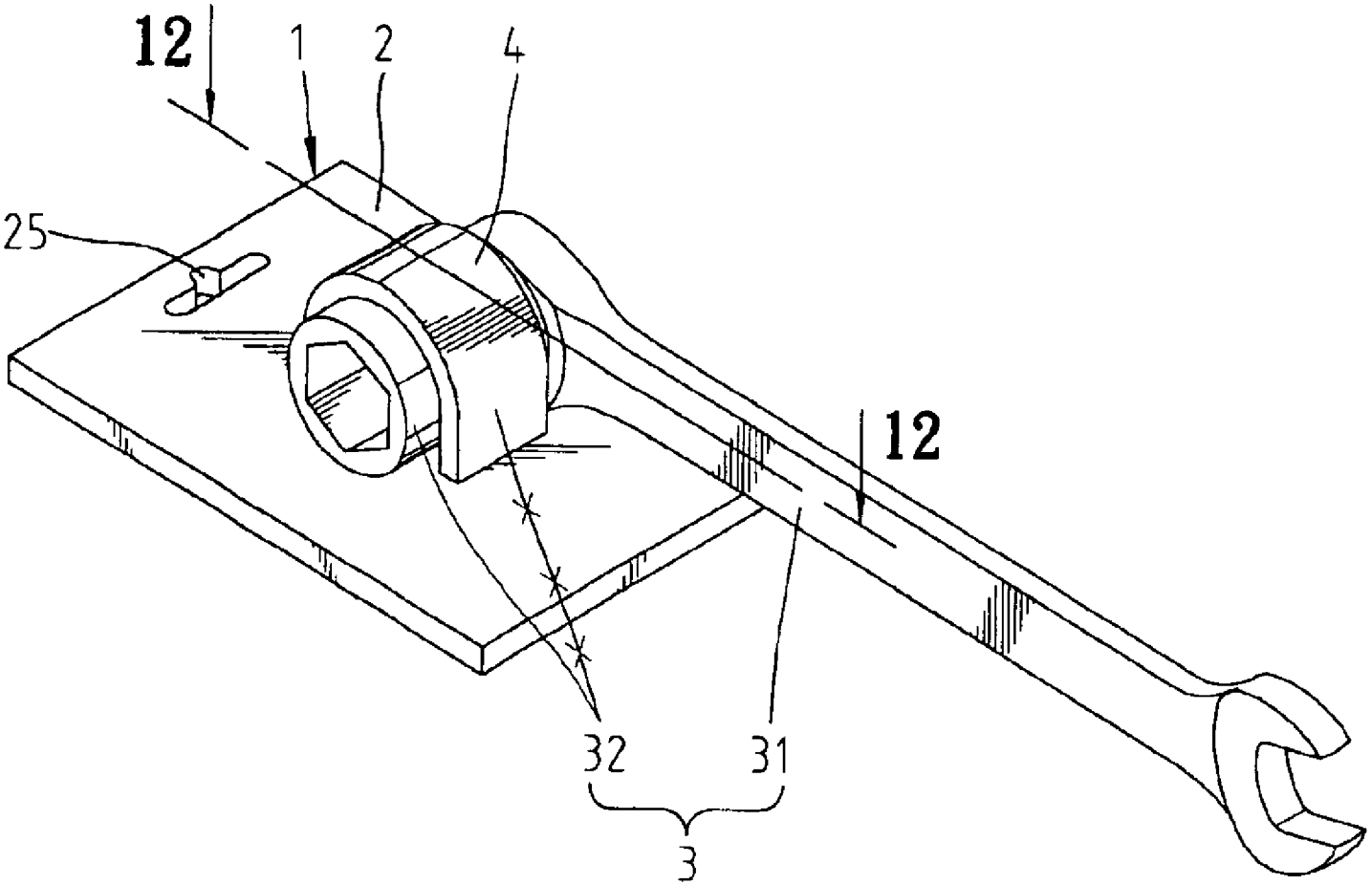
FIG. 11 is a perspective view of a fifth embodiment of the tool try-on device in accordance with the present invention.
Figure 12:
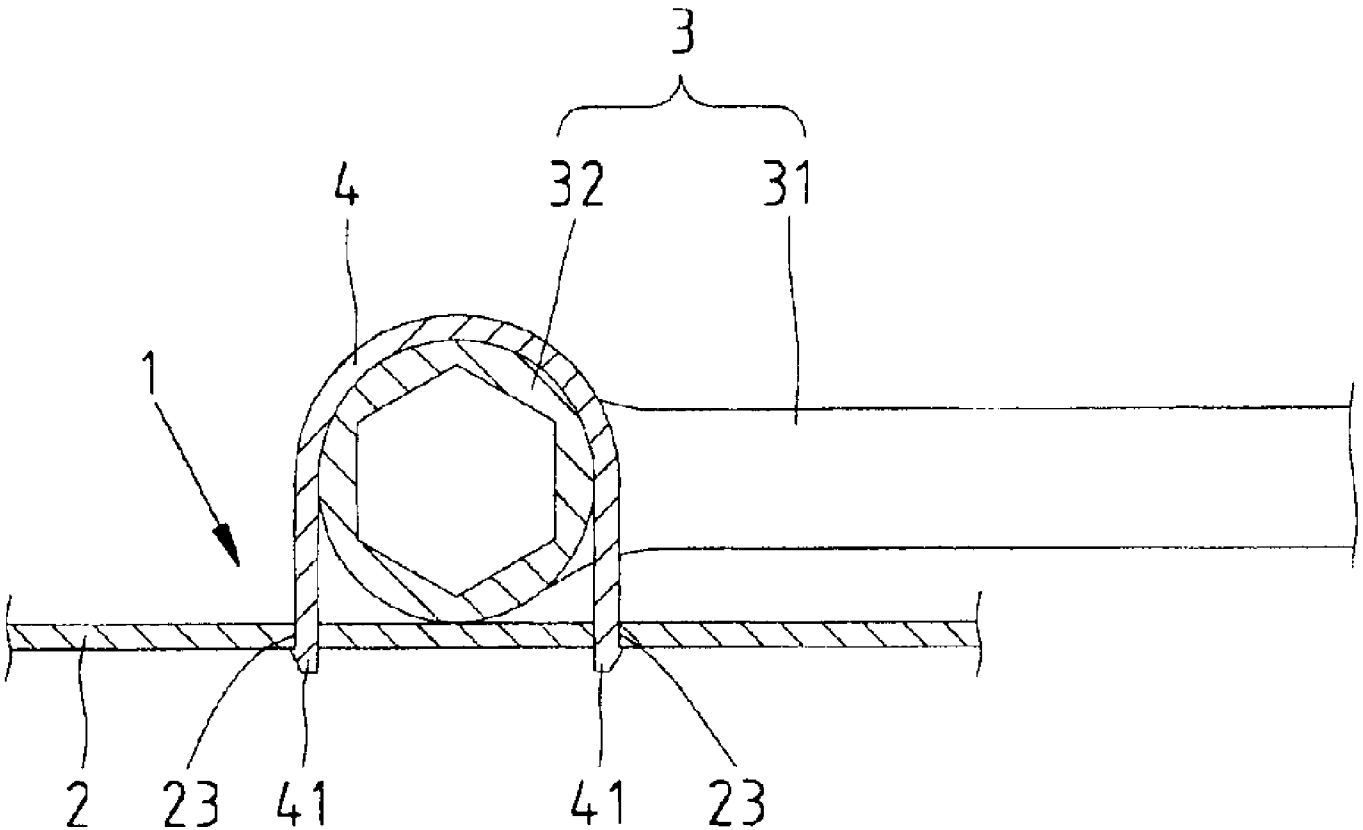
FIG. 12 is a sectional view taken along plane 12—12 in FIG. 11.

FIGS. 11 and 12 illustrate a fifth embodiment of the tool try-on device 1 in accordance with the present invention that is modified from the first embodiment. The tool-holding section 21 in the first embodiment is omitted. The frictional retaining member 4 has two ends each having a snapping member 41 formed thereon. As illustrated in FIG. 12, the respective snapping member 41 of the frictional retaining member 4 is engaged in the respective through-hole 23 of the body 2 and thus retains the rotatable member 32 of the tool 3 in place while providing a frictional contact between the frictional retaining member 4 and the rotatable member 32.

Figure 13:
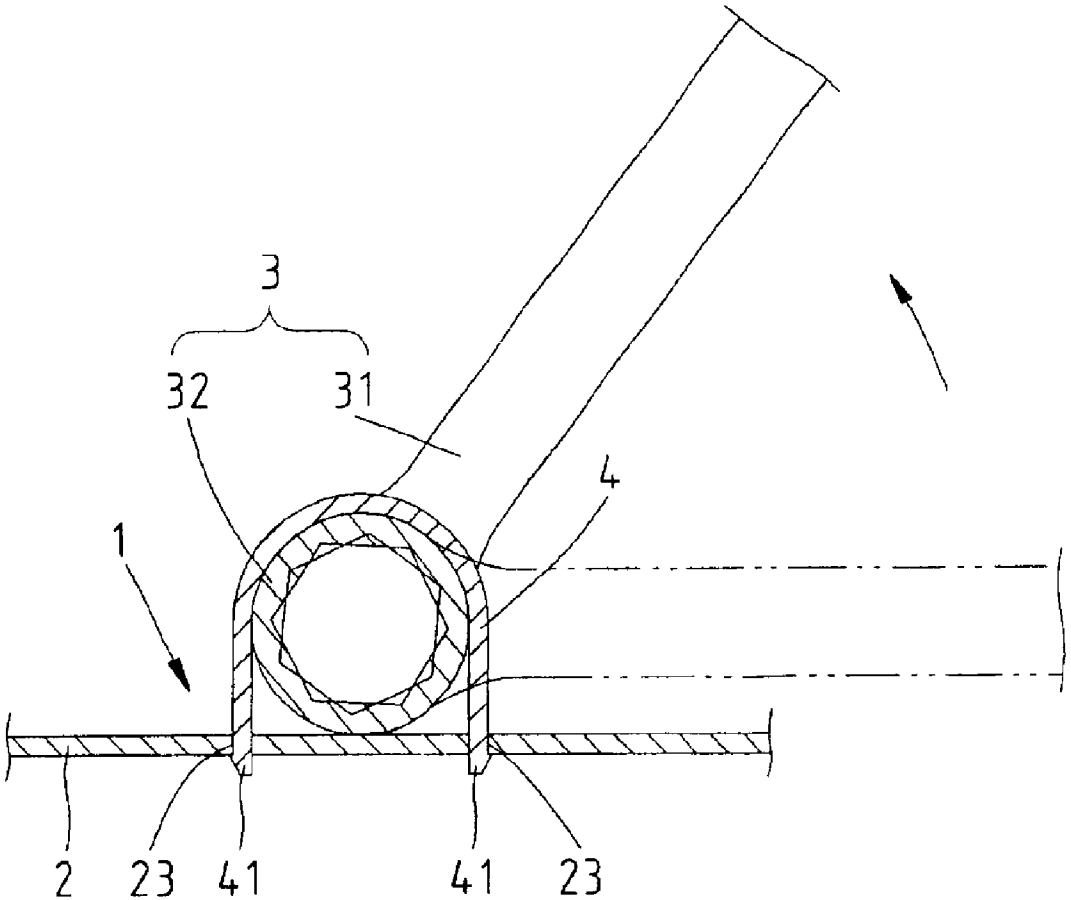
FIG. 13 is a view similar to FIG. 12, illustrating try-on of a tool.
Figure 14:
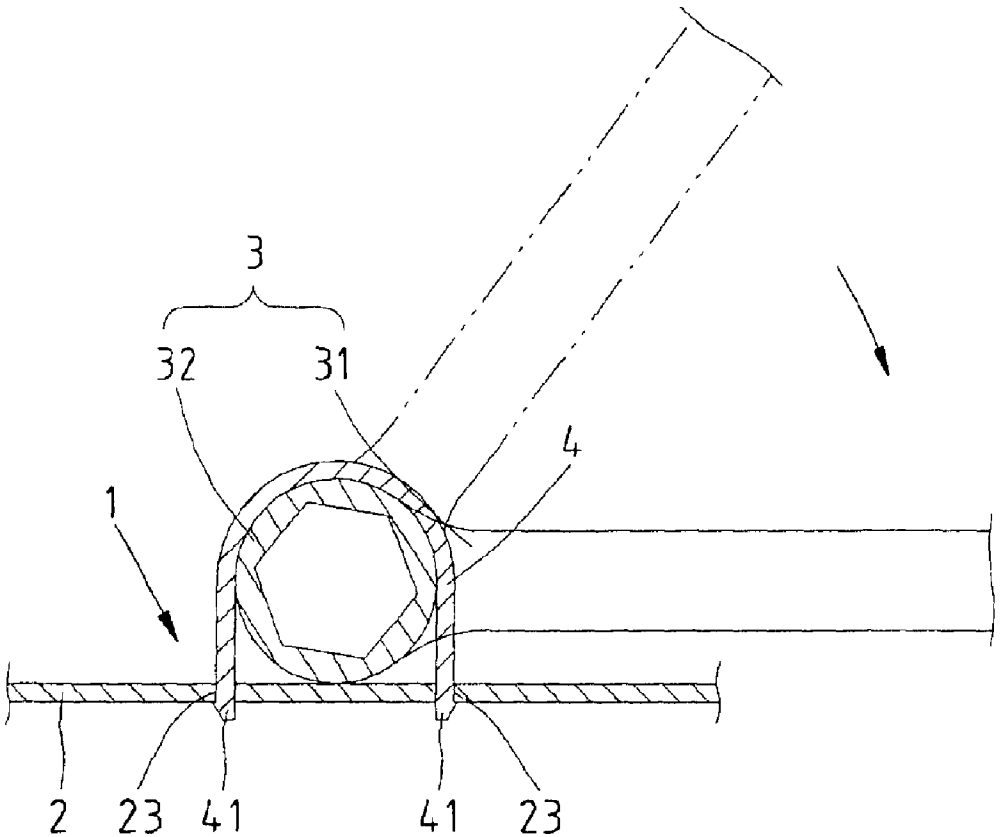
FIG. 14 is a view similar to FIG. 13, illustrating try-on of the tool in a reverse direction.

A customer may turn the handle 31 of the tool 3 in a direction, e.g., counterclockwise. If the rotational force applied to the rotatable member 32 of the tool 3 is greater than the frictional force between the rotatable member 32 and the frictional retaining member 4, the rotatable member 32 is turned together with the handle 31 relative to the body 2, as shown in FIG. 13. The customer may turn the handle 31 of the tool 3 in a reverse direction, e.g., clockwise, in which the rotational force of the handle 31 is absorbed by a ratchet mechanism mounted in the end of the handle 31 of the tool 3 without causing rotational movement of the rotatable member 32. Thus, the rotatable member 32 is not turned when the handle 31 of the tool 3 is turned in the reverse direction, as illustrated in FIG. 14. Thus, the customer may try the tool 3 by turning the handle 31 in the counterclockwise direction as well as in the clockwise direction before buying the tool 3.

Figure 15:
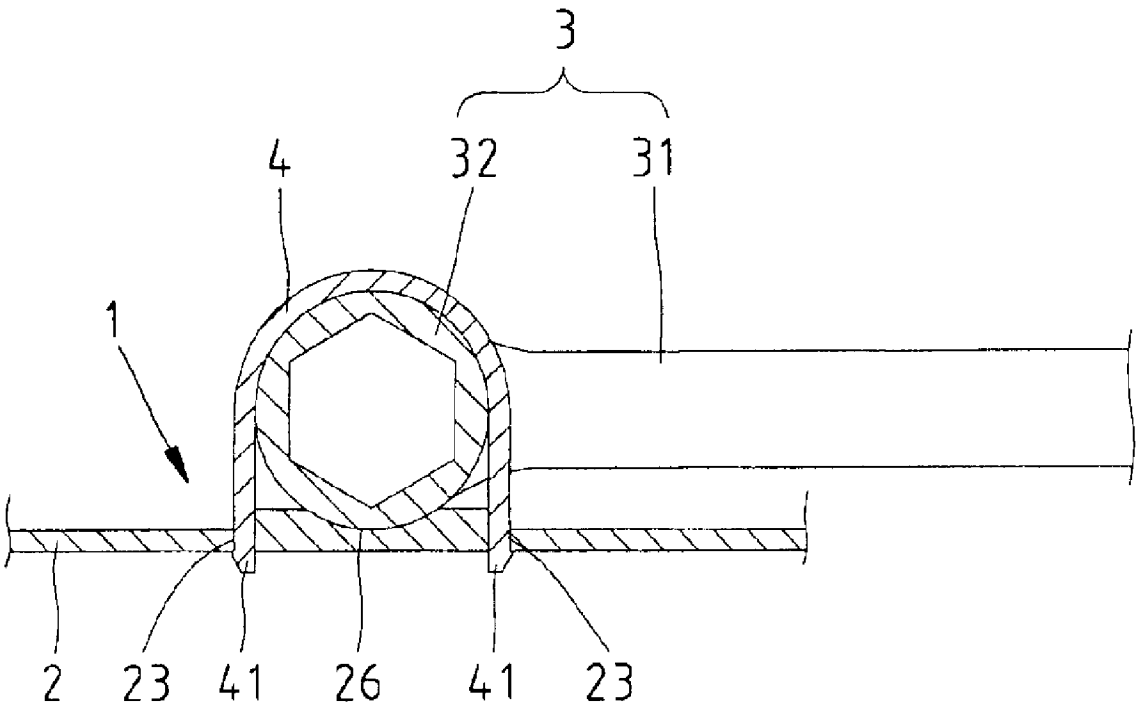
FIG. 15 is a view similar to FIG. 12, illustrating a sixth embodiment of the tool try-on device in accordance with the present invention.

FIG. 15 illustrates a sixth embodiment of the tool try-on device 1 in accordance with the present invention modified from the fifth embodiment. In this embodiment, the body 2 includes an arcuate recessed portion 26 (c.f. FIG. 12) for receiving a portion of the rotatable member 32, thereby more reliably positioning the rotatable member 32 of the tool 3 and providing a larger contact area between the rotatable member 32 and the body 2.

Figure 16:
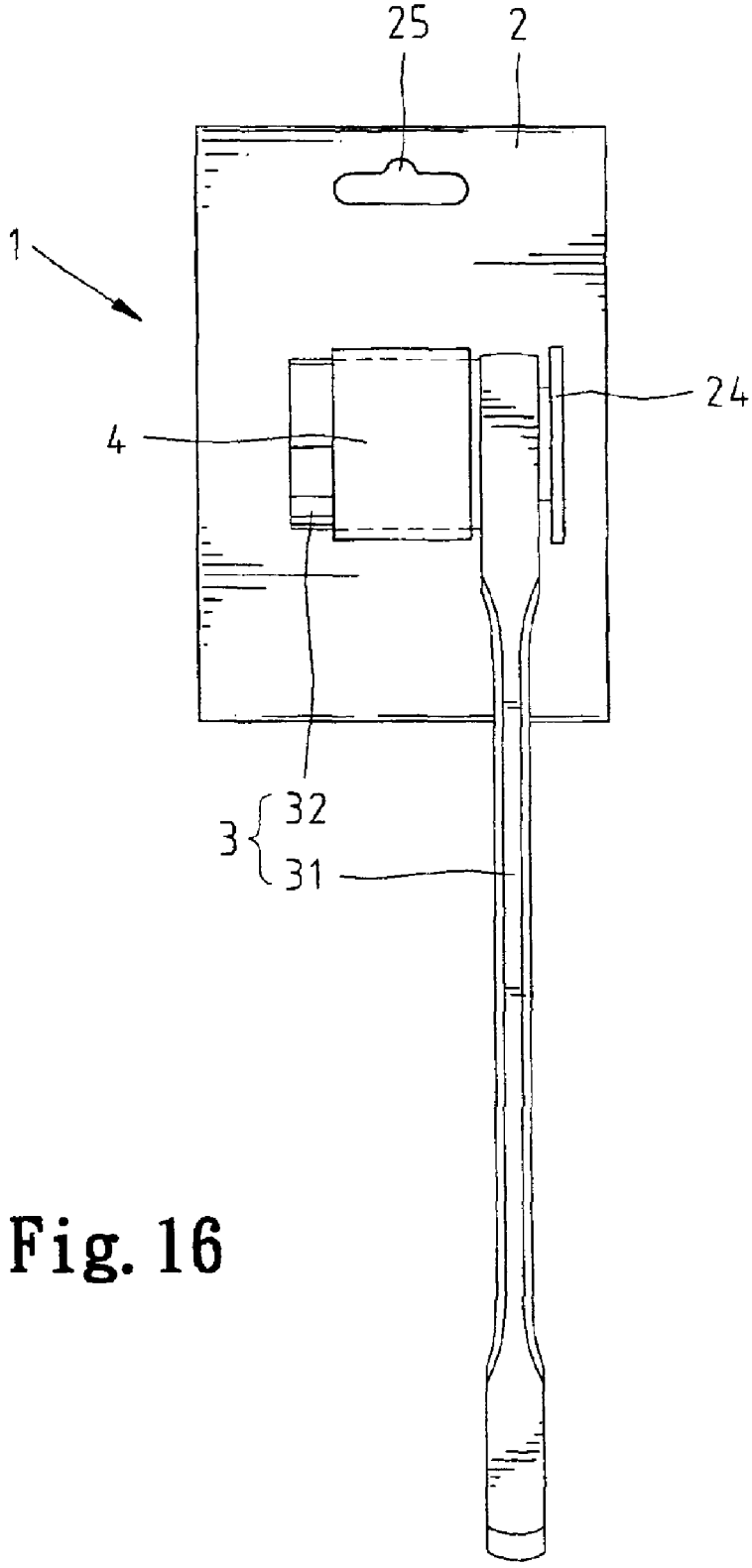
FIG. 16 is a front view illustrating a seventh embodiment of the tool try-on device in accordance with the present invention.

FIG. 16 illustrates a seventh embodiment of the tool try-on device 1 in accordance with the present invention modified from the fifth embodiment. In this embodiment, the body 2 includes a stop 24 adjacent to or in intimate contact with the end of the handle 31 of the tool 1, providing an anti-theft function mentioned in the above embodiments.

Figure 17:
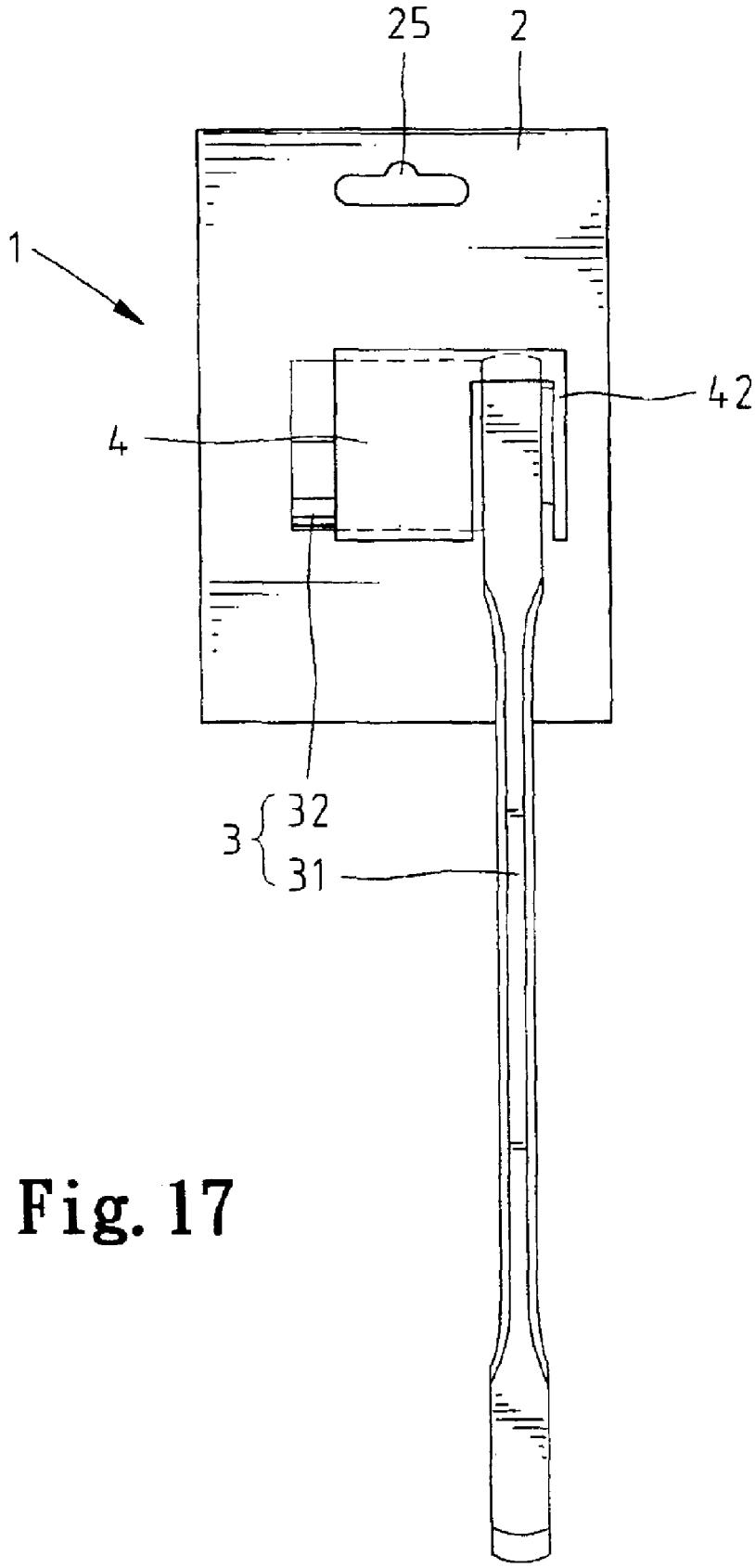
FIG. 17 is a front view illustrating an eighth embodiment of the tool try-on device in accordance with the present invention.

FIG. 17 illustrates an eighth embodiment of the tool try-on device 1 in accordance with the present invention modified from the seventh embodiment. In this embodiment, the stop 24 in the seventh embodiment is replaced by a substantially L-shaped integral stop 42 extending from an end of the frictional retaining member 4, providing an anti-theft function.

Figure 18:
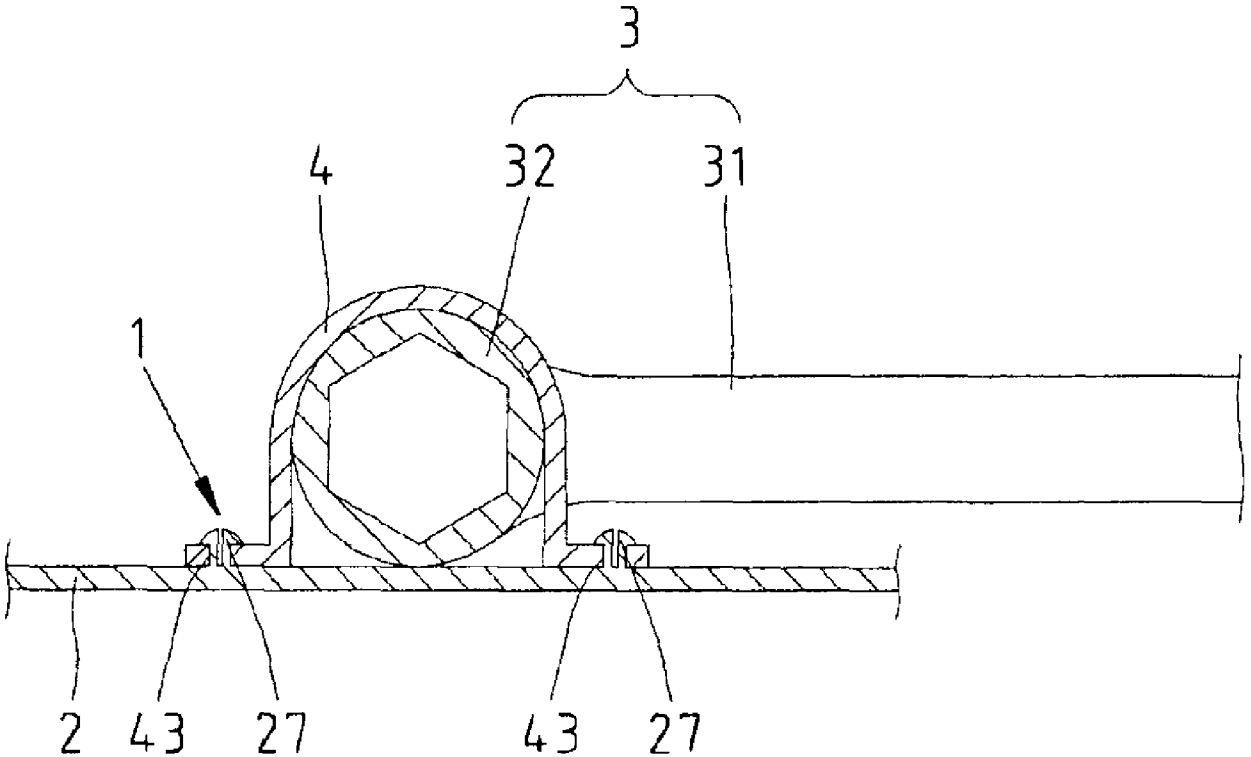
FIG. 18 is a view similar to FIG. 12, illustrating a ninth embodiment of the tool try-on device in accordance with the present invention.

FIG. 18 illustrates a ninth embodiment of the tool try-on device 1 in accordance with the present invention modified from the fifth embodiment. In this embodiment, the body 2 includes two snapping fasteners 27 provided on a side thereof, and the frictional retaining member 4 is substantially U-shaped and has two ends each having a hole 43 into which a respective snapping fastener 27 is engaged. A frictional contact is provided between the frictional retaining member 4 and the rotatable member 32 of the tool 3.

Figure 19:
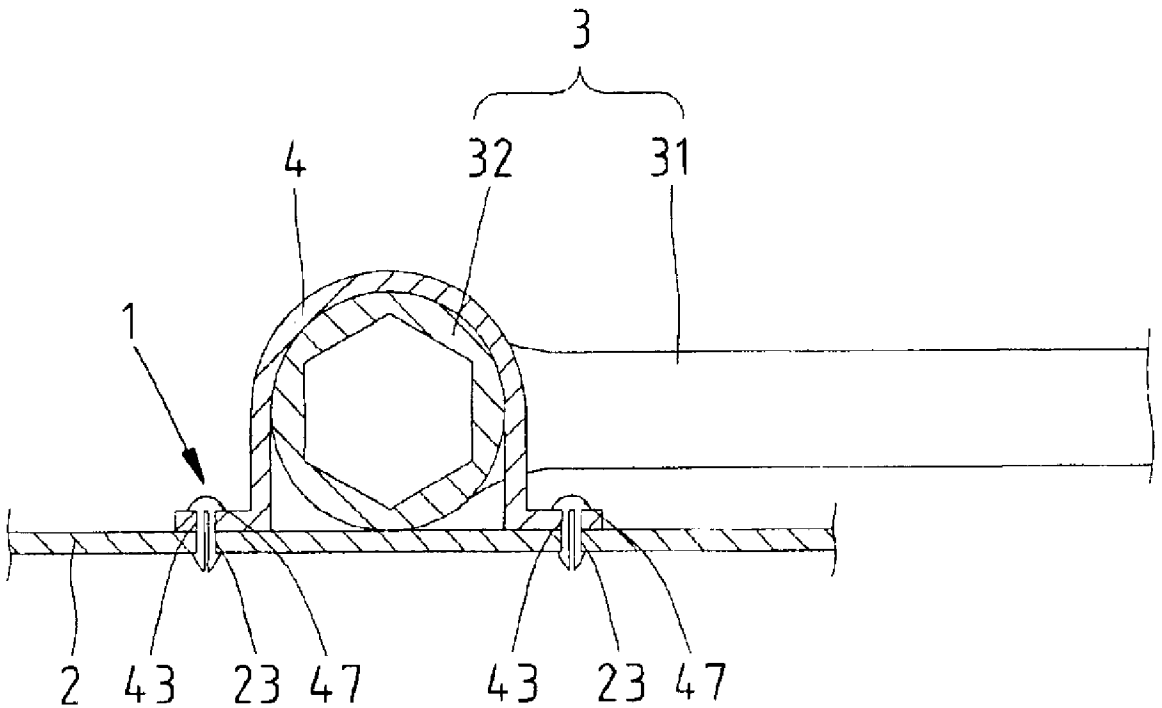
FIG. 19 is a view similar to FIG. 18, illustrating a tenth embodiment of the try-on device in accordance with the present invention.

FIG. 19 illustrates a tenth embodiment of the tool try-on device 1 in accordance with the present invention. In this embodiment, the body 2 includes two through-holes 23, and the frictional retaining member 4 is substantially U-shaped and has two ends each having a hole 43. A snapping fastener 47 is engaged into the respective hole 43 of the frictional retaining member 4 and the respective through-hole 23 of the body 2, thereby retaining the respective end of the frictional retaining member 4 in place and thus providing a frictional contact between the frictional retaining member 4 and the rotatable member 32 of the tool 3.

Figure 20:
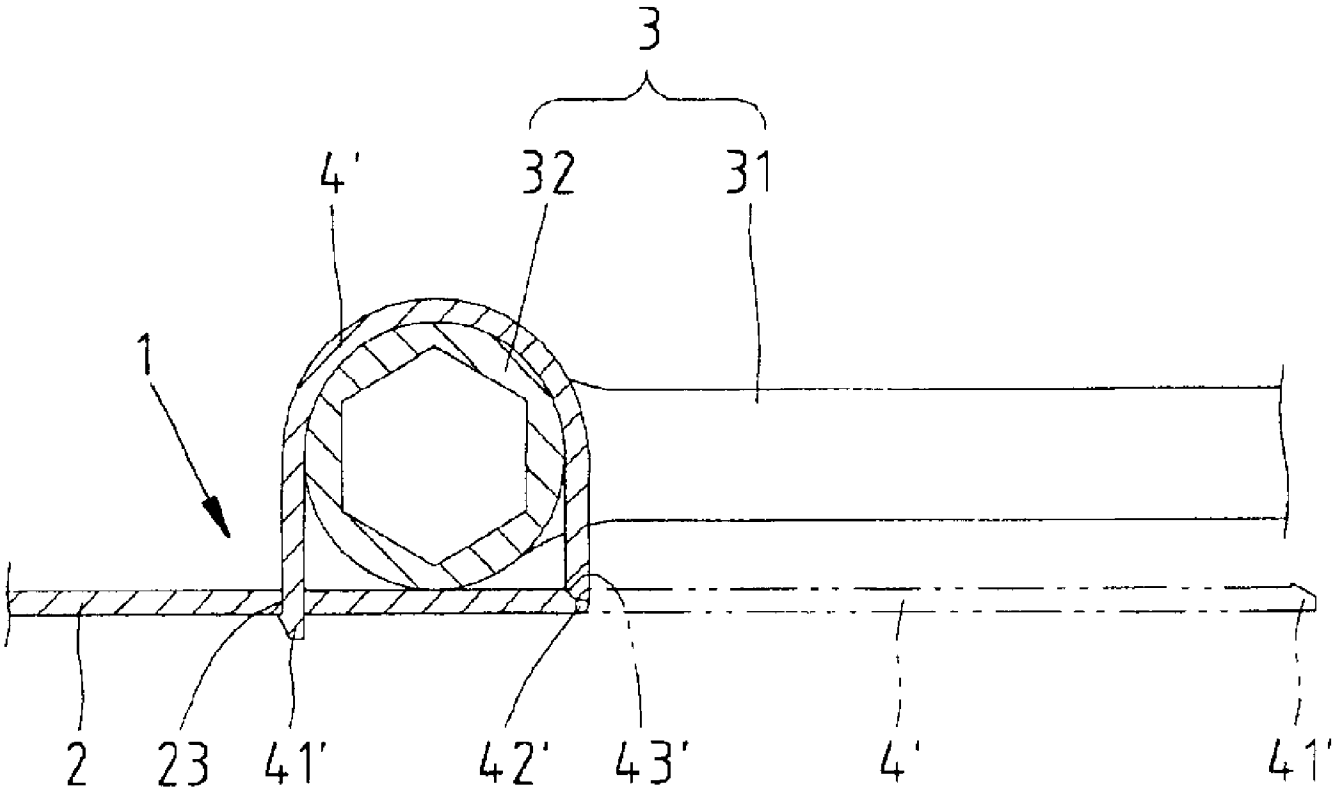
FIG. 20 is a view similar to FIG. 19, illustrating an eleventh embodiment of the try-on device in accordance with the present invention.

FIG. 20 illustrates an eleventh embodiment of the try-on device 1 in accordance with the present invention. In this embodiment, the body 2 has a through-hole 23, and the frictional retaining member (now designated by 4') includes a first end 42' that is integrally formed with the body 2. A substantially V-shaped groove 43' is defined in a joint section between the first end 42' of the frictional retaining member 4' and the body 2, providing a pivotal section that allows pivotal movement of the first end 42' of the frictional retaining member 4' relative to the body 2. As illustrated in FIG. 20, the frictional retaining member 4' may be pivoted from a position shown by phantom lines to a position shown by solid lines, with the frictional retaining member 4' extending across a portion of the outer surface of the rotatable member 32 of the tool 3, and with a snapping member 41' on a second end of the frictional retaining member 4' engaging with the through-hole 23 of the body 2. A frictional force is thus provided between the frictional retaining member 4' and the rotatable member 32 of the tool 3.

Figure 21:
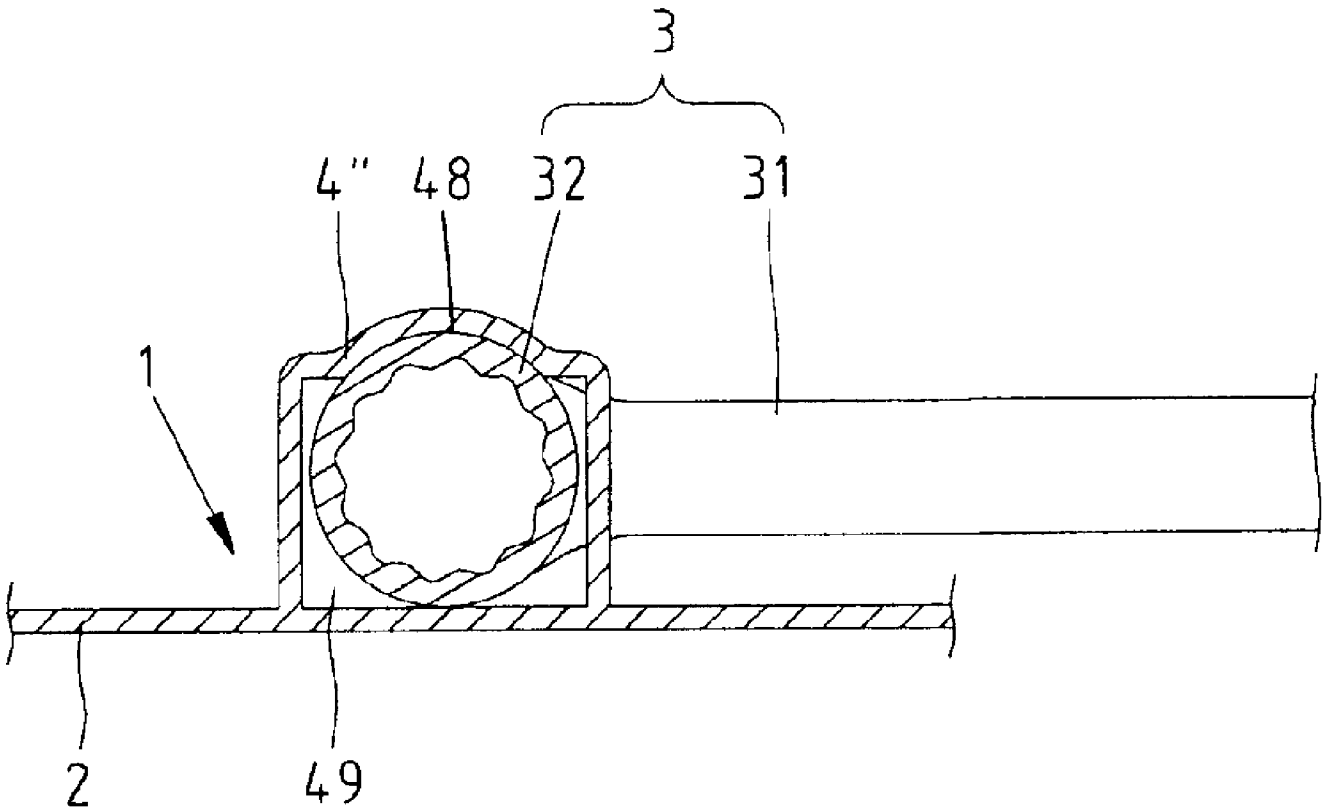
FIG. 21 is a view similar to FIG. 20, illustrating a twelfth embodiment of the try-on device in accordance with the present invention.

FIG. 21 illustrates a twelfth embodiment of the try-on device 1 in accordance with the present invention. In this embodiment, two ends of the frictional retaining member (now designated by 4") are integrally formed with a side of the body 2, defining a compartment 49 between the frictional retaining member 4" and the body 2. The rotatable member 32 of the tool 3 may be inserted into the compartment 49. A wall delimiting the compartment 49 includes an arcuate groove 48 configured to receive a portion of the outer surface of the rotatable member 32. Thus, a frictional force is provided between the frictional retaining member 4" and the rotatable member 32 while allowing rotational movement of the rotatable member 32 relative to the body 2, which is substantially the same as the above-mentioned embodiments.

Figure 22:
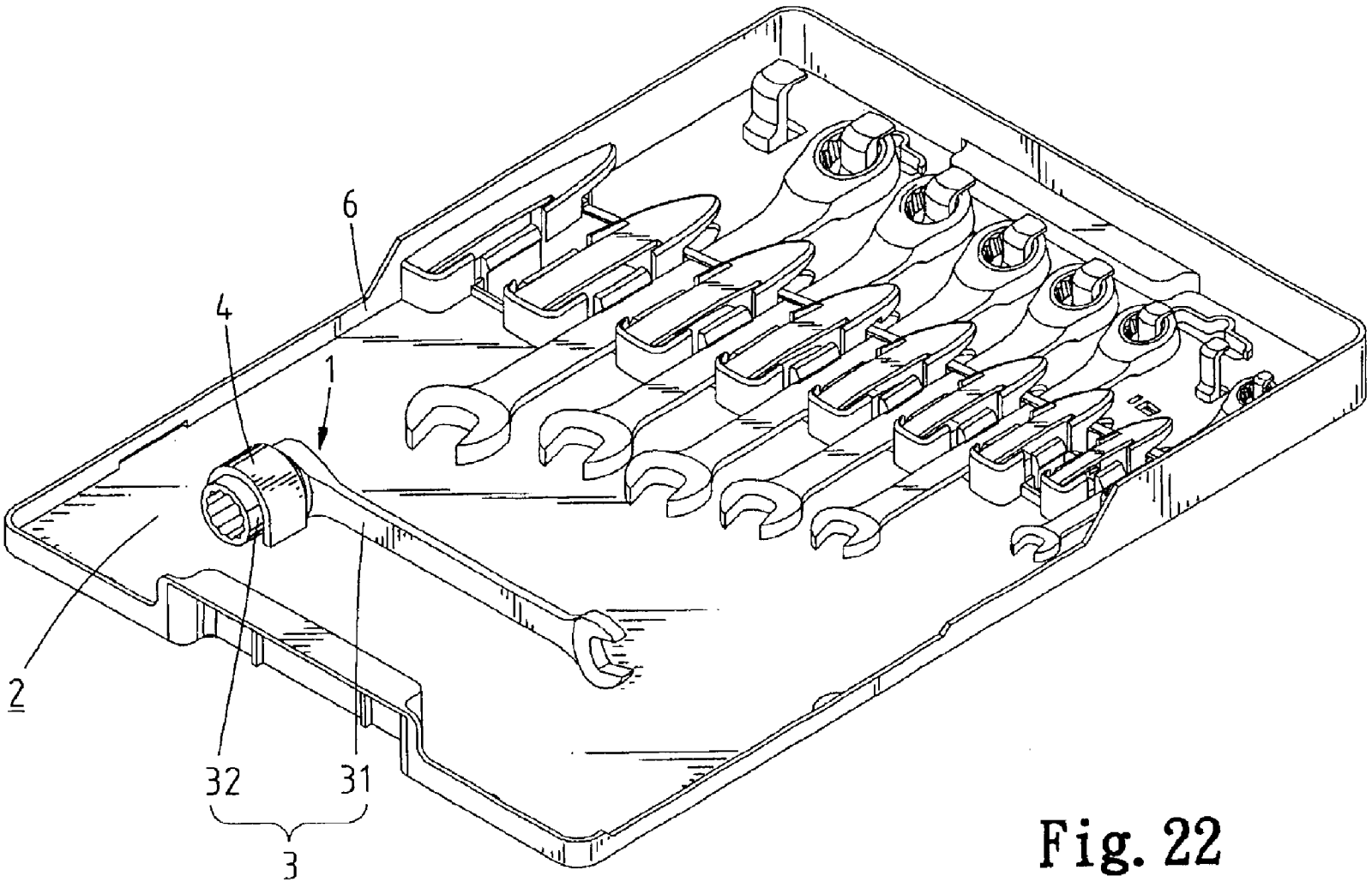
FIG. 22 is a perspective view illustrating a thirteenth embodiment of the try-on device in accordance with the present invention.

FIG. 22 illustrates a thirteenth embodiment of the try-on device 1 in accordance with the present invention. In this embodiment, the try-on device 1 is incorporated into and thus becomes a part of a tool rack 6 of another type.

Figure 23:
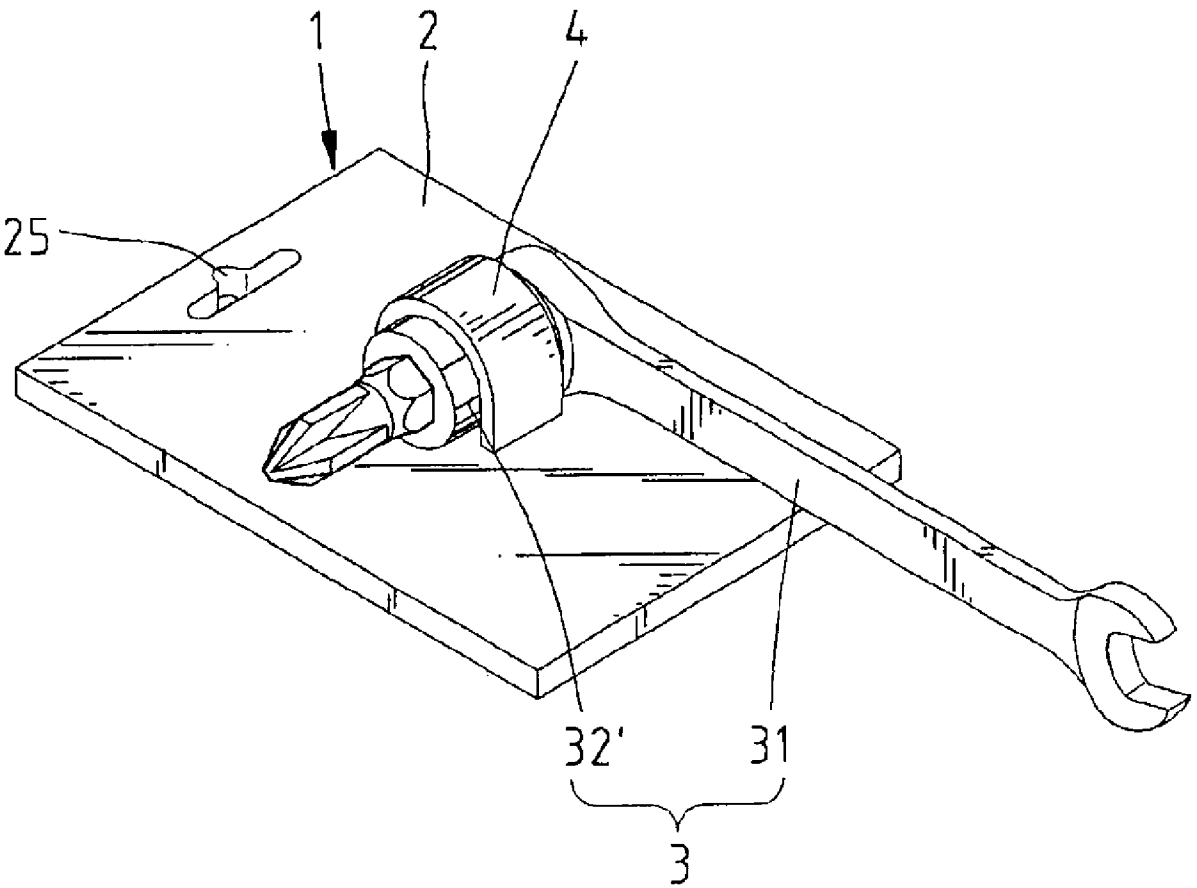
FIG. 23 is a perspective view illustrating a fourteenth embodiment of the try-on device in accordance with the present invention.

FIG. 23 illustrates a fourteenth embodiment of the try-on device 1 in accordance with the present invention. Similar to the fourth embodiment, the rotatable member (now designated by 32') is in the form of an adaptor to which a bit is attached.

In the embodiments using a stop 24, it is noted that the stop 24 may be spaced away from the end of the handle 31 while providing an anti-theft function.

Although the invention has been explained in relation to its preferred embodiment, it is to be understood that many other possible modifications and variations can be made without departing from the scope of the invention as hereinafter claimed.

What is claimed is:

1. An assembly comprising, in combination:

a tool including a handle having an end, with the tool further including a ratcheting rotatable member rotatably mounted to the end of the handle and having an outer surface, with the handle and the rotatable member rotating together when a rotational force is applied to the handle in a ratcheting direction and with the rotatable member allowed to rotate relative to the handle when the rotational force is applied to the handle in a reverse direction reverse to the ratcheting direction; and a tool try-on device including a body, and a frictional retaining member mounted to the body, the frictional retaining member and the body together defining a compartment adapted to receive the rotatable member rotatably mounted to the end of the handle of the tool, the frictional retaining member exerting a frictional force to the outer surface of the rotatable member of the tool for retaining the rotatable member in place unless a rotational force greater than the frictional force is applied to the handle of the tool in the ratcheting direction.

2. The assembly as claimed in claim 1, with the body including two through-holes extending from a first side of the body to a second side of the body opposite to the first side of the body, with the frictional retaining member extending through the through-holes of the body and extending across a portion of the outer surface of the rotatable member of the tool, thereby exerting the frictional force to the rotatable member of the tool.

3. The assembly as claimed in claim 2, with the frictional retaining member including a first end having a hole and a second end having a toothed side, with the second end of the frictional retaining member extending through the hole of the first end of the frictional retaining member, and with the toothed side of the second end of the frictional retaining member engaging with a toothed wall delimiting the hole of the first end of the frictional retaining member.

4. The assembly as claimed in claim 3, with the body including a recessed portion for receiving the rotatable member and the end of the handle of the tool.

5. The assembly as claimed in claim 4, with the recessed portion of the body including an end wall for preventing the tool from being removed.

6. The assembly as claimed in claim 2, with the frictional retaining member including two ends each having a snapping member formed thereon, with each said snapping member of the frictional retaining member being engaged with one of the two through-holes of the body.

7. The assembly as claimed in claim 6, with the first side of the body having an arcuate groove for receiving a portion of the rotatable member.

8. The assembly as claimed in claim 1, with the body including two snapping members formed on a first side thereof, with the frictional retaining member including two ends each having a hole defined therein, with one of the two snapping members of the body engaging with the hole of one of the two ends of the frictional retaining member, thereby securing the frictional retaining member to the body and exerting the frictional force to the rotatable member of the tool.

9. The assembly as claimed in claim 1, with the body including two through-holes extending from a first side of the body to a second side of the body opposite to the first side of the body, with the frictional retaining member including two ends each having a hole defined therein, with a snapping member engaging with the hole of one of the two ends of the frictional retaining member and one of the two through-holes of the body, thereby securing the frictional retaining member to the body and exerting the frictional force to the rotatable member of the tool.

10. The assembly as claimed in claim 1, with the body including a through-hole extending from a first side of the body to a second side of the body opposite to the first side of the body, with the frictional retaining member including a first end integrally formed with the body and a second end having a snapping member formed thereon, with the snapping member being engaged in the through-hole of the body, thereby exerting the frictional force to the rotatable member of the tool.

11. The assembly as claimed in claim 10, with a groove being defined in a joint area between the first end of the frictional retaining member and the body, providing a pivotal section about which the second end of the frictional retaining member is pivotable.

12. The assembly as claimed in claim 1, with the frictional retaining member including two ends that are integrally formed with the body.

13. The assembly as claimed in claim 12, with a wall that delimits the compartment defined between the frictional retaining member and the body having an arcuate groove for receiving a portion of the rotatable member of the tool.

14. The assembly as claimed in claim 1, with the body including a first casing half and a second casing half each having a recessed portion that together define the compartment for receiving the rotatable member and the end of the handle of the tool, with the first casing half and the second casing half including aligned holes through which the frictional retaining member extends, with the frictional retaining member being mounted around the recessed portions, thereby exerting the frictional force to the rotatable member of the tool.

15. The assembly as claimed in claim 14, with the frictional retaining member including a first end having a hole and a second end having a toothed side, with the second end of the frictional retaining member extending through the hole of the first end of the frictional retaining member, and with the toothed side of the second end of the frictional retaining member engaging with a toothed wall delimiting the hole of the first end of the frictional retaining member.

16. The assembly as claimed in claim 1, further including a tool-holding section for holding at least one tool.

17. The assembly as claimed in claim 1, further including a stop on a first side of the body for preventing the tool from being removed.

18. The assembly as claimed in claim 1, with the frictional retaining member including an integral stop extending therefrom for preventing the tool from being removed.

19. The assembly as claimed in claim 18, with the integral stop of the frictional retaining member being L-shaped. The tool try-on device as claimed in claim 1, with the rotatable member being not turned when the handle of the tool is turned in a reverse direction reverse to the ratcheting direction.

20. The assembly as claimed in claim 1 wherein the frictional retaining member includes an inner side contacting the outer surface of the rotatable member, with the inner side having a non-smooth section.

21. The assembly as claimed in claim 20 wherein the frictional retaining member can be tightened against the rotatable member to at least partially wind the frictional retaining member on the outer surface of the rotatable member.

22. The assembly as claimed in claim 21 with the rotatable member being rotatably mounted to the end of the handle about a rotation axis, with the handle extending from the end of the handle in a radial direction relative to the rotational axis.

* * * * *